US007024953B1

(12) United States Patent
Weiss

(10) Patent No.: US 7,024,953 B1
(45) **Date of Patent: *Apr. 11, 2006**

(54) APPARATUS AND METHOD FOR TUNING A GOLF SHAFT

(76) Inventor: Richard M. Weiss, 9050 SW. 69th Ct., Miami, FL (US) 33156

( * ) Notice: Subject to any disclaimer, the term of this patent is extended or adjusted under 35 U.S.C. 154(b) by 371 days.

This patent is subject to a terminal disclaimer.

(21) Appl. No.: 10/162,908

(22) Filed: Jun. 6, 2002

Related U.S. Application Data

(60) Continuation of application No. 09/739,765, filed on Dec. 20, 2000, now Pat. No. 6,494,109, which is a division of application No. 09/262,045, filed on Mar. 4, 1999, now Pat. No. 6,183,375.

(51) Int. Cl.
*G01N 19/00* (2006.01)

(52) U.S. Cl. ..... 73/865.9; 473/289

(58) Field of Classification Search ..... 73/865.3, 73/865.9, 65.01, 65.03, 814; 473/300, 316, 473/322, 289

See application file for complete search history.

(56) References Cited

U.S. PATENT DOCUMENTS

| | | | | |
|---|---|---|---|---|
| 4,169,595 | A | 10/1979 | Kaugars | 273/80 R |
| 4,558,863 | A | 12/1985 | Haas et al. | 273/77 A |
| 4,682,504 | A | 7/1987 | Kobayashi | 73/854 |
| 4,958,834 | A | 9/1990 | Colbert | 273/77 A |
| 5,040,279 | A | 8/1991 | Braly | 29/407 |
| 5,429,008 | A | 7/1995 | Matsumoto et al. | 73/862.639 |
| 5,731,524 | A | 3/1998 | Matsumoto et al. | 73/814 |
| 5,763,770 | A | 6/1998 | McConnell et al. | 73/65.03 |
| 5,976,028 | A * | 11/1999 | Ciccarello et al. | 473/289 |
| 6,183,375 | B1 * | 2/2001 | Weiss | 473/289 |
| 6,250,168 | B1 * | 6/2001 | D'Aguanno | 73/865.3 |
| 6,494,109 | B1 * | 12/2002 | Weiss | 73/865.9 |
| 2001/0027137 | A1 | 10/2001 | Weiss | 473/289 |

* cited by examiner

*Primary Examiner*—Hezron Williams
*Assistant Examiner*—Rodney Frank
(74) *Attorney, Agent, or Firm*—Fish & Neave IP Group of Ropes & Gray LLP; Jeffrey H. Ingerman

(57) ABSTRACT

A method of making a golf club includes making a first determination of the location of the effective seam in a shaft and then more precisely locating the seam before attaching a golf club head with the face of the club head facing in a neutral direction.

3 Claims, 4 Drawing Sheets

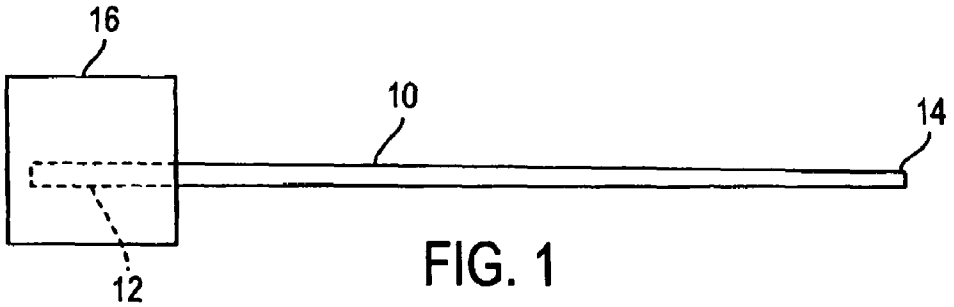
FIG. 1
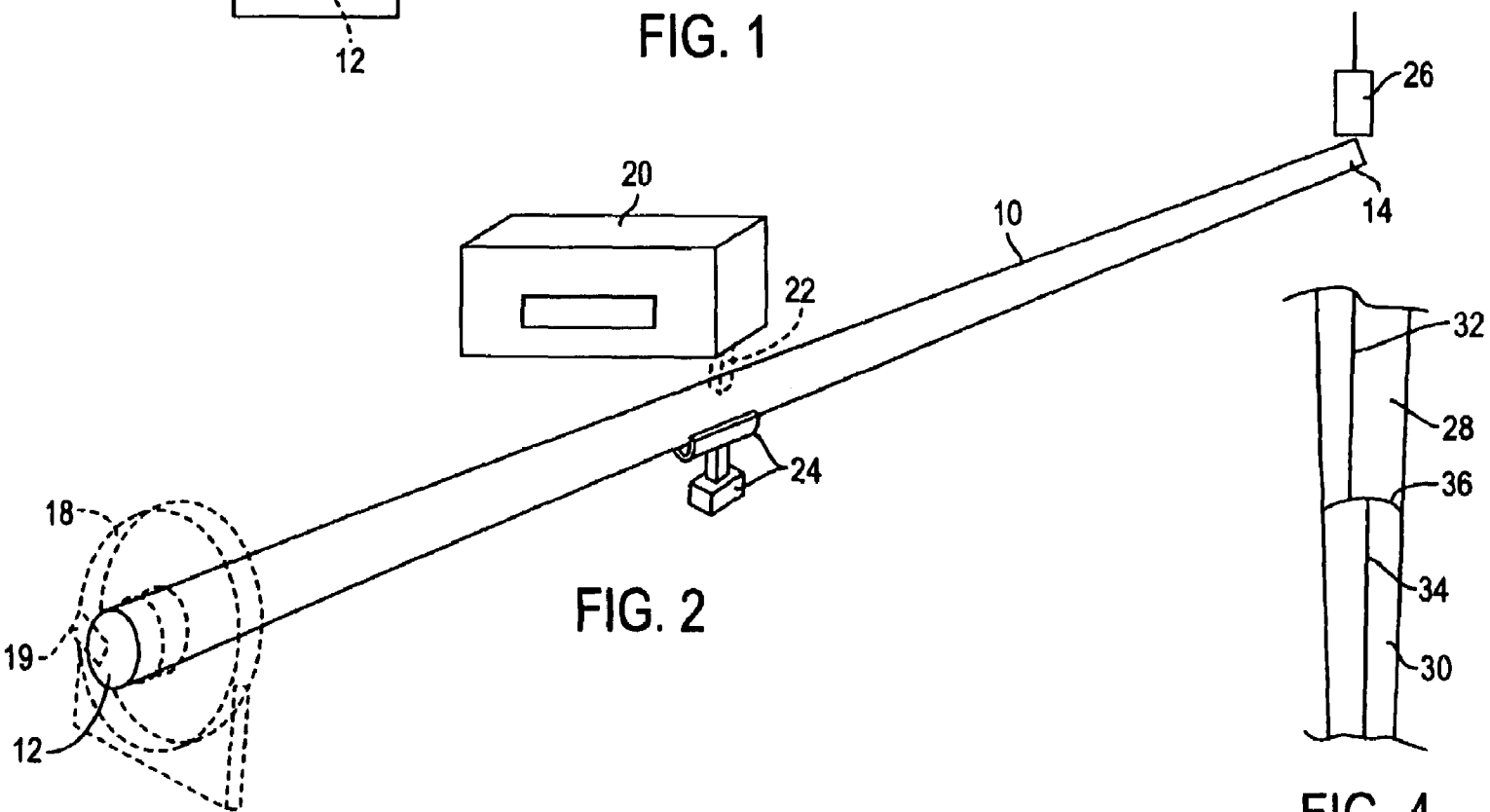
FIG. 2
FIG. 4

APPARATUS AND METHOD FOR TUNING A GOLF SHAFT

CROSS REFERENCE TO RELATED APPLICATIONS

This is a continuation of U.S. patent application Ser. No. 09/739,765, filed Dec. 20, 2000, now U.S. Pat. No. 6,494,109, which is a division of U.S. patent application Ser. No. 09/262,045, filed Mar. 4, 1999, now U.S. Pat. No. 6,183,375.

FIELD OF THE INVENTION

The present invention relates to apparatus and a method for tuning a golf shaft to enable more accurate use of the assembled golf club. More particularly, use of the invention will avoid significant irregularities found in shafts made of any material including steel and composite material such as carbon fibers.

BACKGROUND OF THE INVENTION

According to U.S. Pat. No. 4,958,834, a golf stroke with a club that has a shaft that has been adjusted to compensate for the presence of a seam is likely to be more accurate and will achieve greater distance. As recognized in this patent, the task of determining the location of the seam in a metal shaft is important to accomplish the object of the invention. As a first approximation, the method disclosed in the aforementioned patent improves a club's performance by compensating for the presence of a seam with metal shafts that have a well-defined seam along the longitudinal axis of the shaft. As is well recognized, a golf swing is not an exact performance and any improvement in the club will assist a golfer generally or will reduce equipment-induced mis-hits.

The aforementioned patent describes a manual technique for determining the location of the seam in metal and composite shafts. It has become apparent, however, that this technique is only approximate and generally only locates the seam in a quadrant of the four quadrants present. With shafts made of carbon fibers and other composite materials, complications arise due to the manner in which these types of shafts are manufactured. For a large number of shafts, there is only a roughly defined seam. This results from the fact that for some shafts, several sheets of carbon fiber material are rolled typically by unskilled workers before setting the rolled sheets in an adhesive and prior to applying the surface coating. The effect is to make the definition or location of the effective seam difficult. Even were a worker to form a shaft using a single sheet of the carbon fibers, overlapping of the ends of the sheet can obscure the location of the effective seam. In this context, effective seam will be understood to mean a line extending longitudinally along the shaft surface that causes the shaft to bend and/or twist when used in a golf stroke irregularly when the effective seam is improperly positioned relative to the clubface. Of particular interest are the recently introduced filament wound shafts where a fiber strand is wrapped on a mandrel typically at a 45° angle to the axis of the mandrel with subsequent wraps being in the opposite direction as the previous wrap. Once the adhesive and the outer coating applied an effective seam still is detectable by the method this invention.

SUMMARY OF THE INVENTION

The present invention provides a method for determining the location of the effective seam in composite material shafts as well as a metal butt-welded shaft seam with much greater precision than previous techniques. In addition, it has been discovered that the shaft of most clubs has a side or surface portion that is in compression and another side 180° apart from the compression side that is in tension on the opposite side of a shaft. It is important according to the invention to determine which surface portion is in tension, that is, harder, and to locate that surface in a selected position relative to the clubface.

In summary, the handle end of the shaft without a cover in place is held in a grip or vise; the quadrant of the shaft containing the seam is determined by the deflection technique as described in U.S. Pat. No. 4,958,834. According to one form of the invention, the shaft is then mounted again with the end that will be attached to a club head adjacent a deflection board which is preferably provided with an electronic digital readout. The shaft when deflected in a plane will only oscillate substantially in that plane when the effective seam lies in that same plane. As noted above, according to the invention, one side of the shaft will be the tension side and the opposite side, 180° apart on the opposite side of the shaft will be the compression side. The compression side of the shaft yields when a club head strikes a ball while the tension side is more resistant to impacts and is therefore the stronger, that is harder, side of the shaft. Preferably the tension side contains the effective seam. Pressure may be then applied to the shaft to determine which side supports the greater amount of pressure. Typically a user then selects the side that supports the greater amount of pressure to minimize the club head deflection in terms of torquing or twisting during the golf swing. As is noted in the aforementioned patent, the mounting of a club head on the shaft is then done with the face of the club pointing in a direction normal to the selected side. That is, a line perpendicular to the clubface and perpendicular to the seam on the shaft will point in the same direction. The clubface direction may be varied about the selected position to achieve desired golf shots that will fade or draw consistently. It is preferable under most circumstances that the clubface be positioned to achieve a consistently straight shot.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 1 is a schematic illustration of a first step of the method of the present invention;

FIG. 2 is a schematic illustration of a further step of the invention;

FIGS. 4 and 5 are illustrations of the sheet technique of manufacturing a golf shaft;

DETAILED DESCRIPTION OF THE INVENTION

Figure 7:
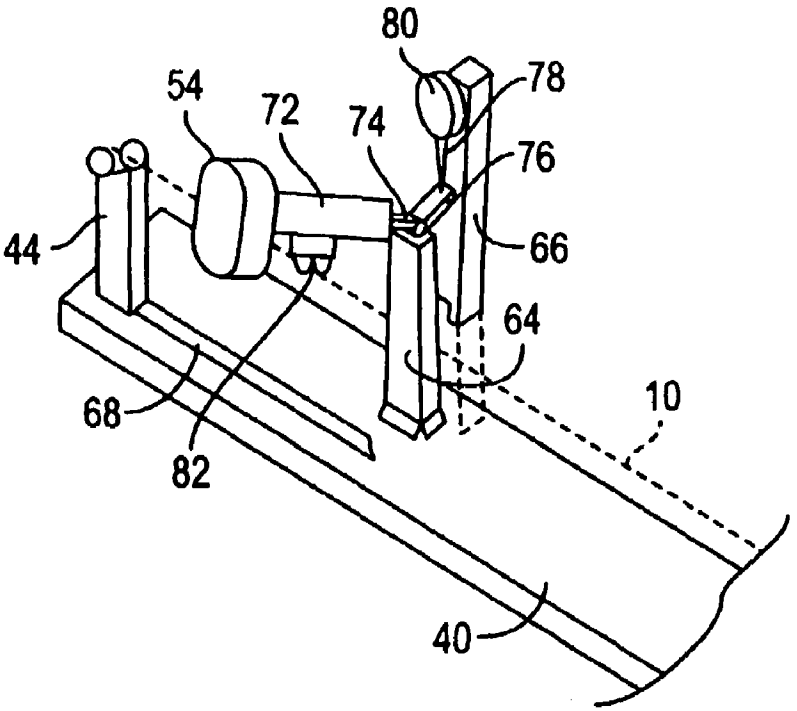
FIG. 7 is a detailed perspective view of the a portion of the apparatus of FIG. 6.

Referring to the drawings, wherein like numerals refer to corresponding parts throughout the several views, there is shown in FIG. 1, a schematic setup for determining the approximate location of the effective seam in a golf club shaft 10. In setting up the shaft 10 for testing, the butt end 12 is fixed in a gripping device 16 while the tip end 14 is left free for movement. A weight is attached to the tip of about 200 gm. The butt end 12 is stripped of any grip or cover to assure accuracy in the determination. The device as shown in FIG. 7 of U.S. Pat. No. 4,958,834 may be employed and the disclosure of U.S. Pat. No. 4,958,834 is incorporated herein by reference. According to the aforesaid patent, a user will deflect the tip 14 manually and observe the resulting movement of the tip 14.

Figure 8:
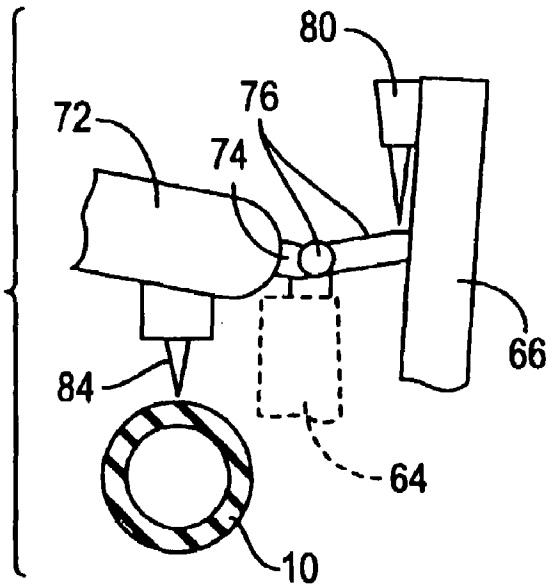
FIG. 8 is an enlarged view of a portion of the apparatus of FIG. 6 taken along line 8—8 of FIG. 6.

It has been determined that where the flexing is done in a plane that does not coincide with the effective seam, the tip will after a brief period move erratically, such as by orbiting in a FIG. 8 pattern for a time instead of in a regular reciprocating manner such as by oscillating in a single plane. The user may then either rotate the shaft relative to the device 16 and deflect the shaft tip 14 again or simply deflect the tip 14 in a different plane. This is repeated until the tip 14 oscillates substantially in a single plane.

According to the present invention, the foregoing steps determine in which quadrant the effective seam lies of the four quadrants available in a conventional golf shaft made of steel or composite materials such as carbon fibers. The present invention provides useful refinements of the foregoing steps to enable a user to more accurately determine the exact location of the effective seam of the shaft to within approximately one degree.

To achieve this, the shaft should be marked to indicate the quadrant selected after the first step has been completed. Then, the butt end 12 is located in an anchor device 18 and secured by a clip 19 against slippage. The marked quadrant should be facing in a selected direction such as vertically upwardly as this is usually easier to observe. Intermediate the tip 14 and butt end 12, a load measuring device including a cradle 24, a sensor finger 22 and an electronic readout 20 that measures movement of the finger 22 is positioned to engage the opposite sides of the shaft 10 from the cradle as shown in FIG. 2. Then, a known weight 26 of approximately 100 to 200 grams is imposed on the tip 14 to deflect or bend the shaft tip 14. The amount of deflection sensed by the finger sensor 22 is observed on the readout 20. A series of these measurements are carried out over the marked quadrant determined in the above deflecting and observing step. The readout that numerically is the lowest corresponds to the effective compression side where the seam or spine is located while the effective tension side of the shaft will be located 180° apart on the opposite side of the compression side. Conversely, if the tension side is the marked quadrant, then the highest reading will correspond to the tension side location while the compression side will be located on the opposite side of the shaft. A club head can then be fastened in the conventional manner to the tip 14 with the clubface facing in the direction of the golf shot and in the same direction that the tension seam faces. That is, a line perpendicular to the clubface must also be perpendicular to the selected shaft seam. For a left handed player, the club face should be set to face in the opposite direction as the club face for a right handed player. It will be understood that the clubface should point in the either the direction of a perpendicular to the compression or tension sides as these sides of the shaft are the neutral positions.

Figure 3:
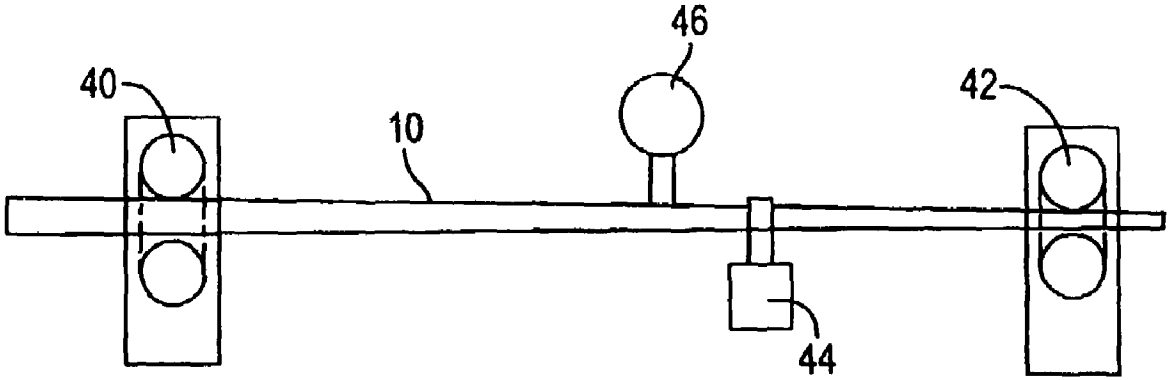
FIG. 3 is a schematic illustration of another arrangement for detecting the seam location.

Another method of more precisely locating the seam is illustrated in FIG. 3 where the shaft 10 has its opposite ends 12 and 14 securely mounted in rotatable bearing rings 40, 42. A weight 44 is attached adjacent the midpoint of the shaft and a deflection gauge 46 is attached to the shaft 10 adjacent the weight 44. The weight must be of a magnitude sufficient to deflect the shaft a small amount as noted above. The user then rotates the shaft through the quadrant previously described while for each turn observing the reading on the gauge 46. In this arrangement, the highest number corresponds to the seam location where the material is in compression while the opposite side of the shaft will be the tension side, which will yield the lowest reading. Other types of gauges may, of course, be used which give a high number for the tension side and a low number for the compression side of the shaft.

Figure 5:
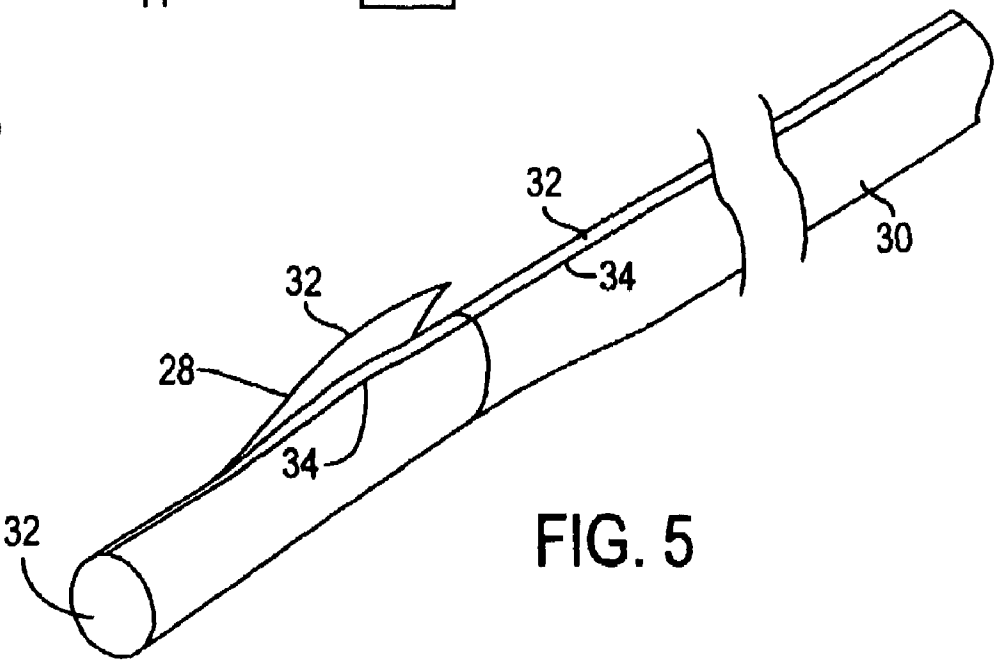

In FIGS. 4 and 5, there is shown a portion of a composite shaft at a stage of manufacture prior to coating the shaft with its outer layer and after wrapping two or more sheets 28 and 30 on a forming mandrel 32. As shown, each sheet will have terminal edges 32 and 34 which sometimes abut but often overlap. The edges 32 and 34 are often not aligned with one another although in some instances they may be. In the past, where the edges of a sheet of fibers are not aligned properly, this made a determination of the location of the effective seam for the finished shaft difficult to detect. Where a single sheet of carbon fibers is used to form the shaft along its entire length, overlapping of the edges also tends to obscure the effective seam. Use of the method of this invention will minimize this difficulty by detecting the effective seam resulting from the resolved forces the result from somewhat less than diligent manufacturing techniques.

Figure 6:
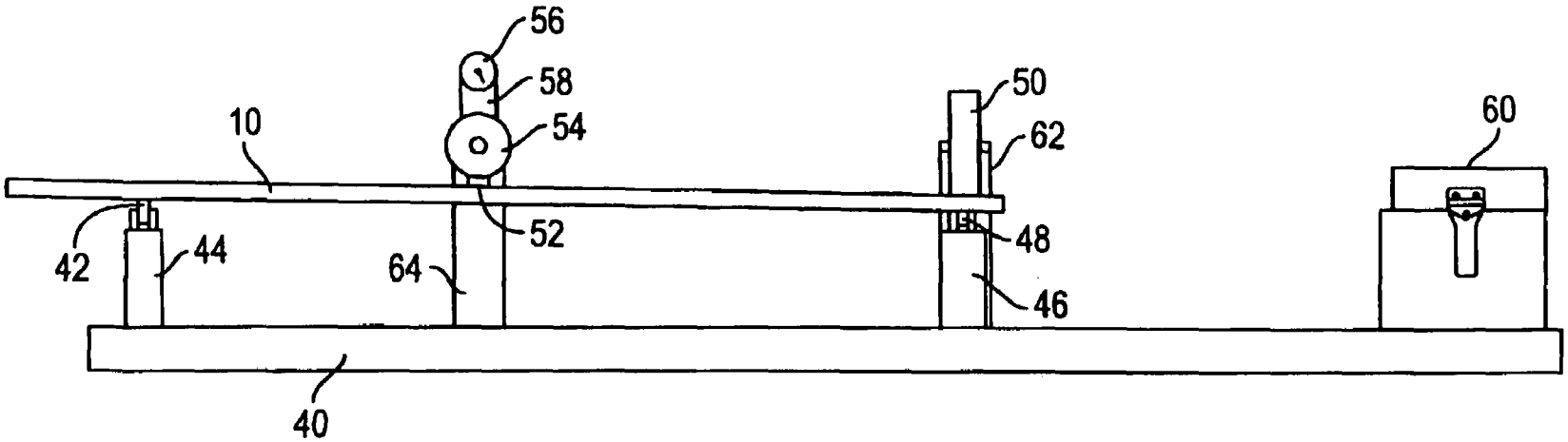
FIG. 6 is an elevational view of an apparatus according to the present invention.

A useful device for rapidly detecting almost exactly the location of an effective seam in any shaft material is shown is FIGS. 6–8. Additionally, the apparatus can be easily modified for frequency testing of shaft as described below.

In FIG. 6, an extended base 40 is provided at one end with a support post 44 for a set of rotatable bearings 42 of conventional construction. Spaced a selected distance from post 44 is another post 46 with also supports a set of rotatable bearings 48. The spacing between posts 44 and 46 should be no greater than the shortest commercial shaft to be tested in the device as will be apparent to those skilled in this art. Post 46 will have mounted on base 40 adjacent thereto a friction wheel 50 which should be pivotal on support arms 62 so as to movable into and out of engagement with the surface of a shaft 10 supported on bearings 42 and 48. Intermediate the posts 44 and 46 is a load imposing device 54 and measuring device 56 each mounted on a respective support post 64 and 66 (FIG. 7).

Referring to FIG. 7, to allow accommodation of virtually any length shaft, the posts 44 and 46 may be mounted in slots one of which is shown at 68 for post 44. Tightening nuts will be located on threaded pins extending from the bottom of each post 44, 46 to allow ease of spatial adjustment of the posts relative to each other and the loading device on post 64. Also shown in FIG. 7 is a perspective view of the load imposing device 54. This comprises a lever arm 72 to the outer end of which is removably attached a weight 70. The inner end is pivotally connected on pivot pin 74 to a recording arm 76 which engages a sensing finger 78 to load detector 80 mounted on a post 66. A bearing surface 82 is mounted on the lower side of arm 72 so as engage the outer surface of a shaft 10 disposed between the bearings 42 and 48. With the apparatus as thus far described, the user need simply place the shaft on the bearings 42 and 48 and rotate the wheel 50 to effect rotation of the shaft. The load of weight 54 will be engaged by the user before shaft rotation is effected. Where the quadrant containing the effective seam is know, only that quadrant need be investigated. However, this apparatus will allow the user to avoid that step due to its ease of use in completely rotating the shaft about its circumference while observing the read out of the gauge 56. The lowest number will correspond to the hard or tension side of the shaft as the hardest side will deflect under the load the least. This will be the effective seam. To precisely locate the seam, the bearing 82 may take the form of a knife edge 84 as shown in FIG. 8.

When the seam has been located and marked, the user may check his work by clamping the butt end of the shaft in a clamp 60 mounted at the other end of the base 40 with one of the two sides, tension or compression, facing the direction of the club face normal. The other side of the shaft will face 180° opposite. When the tip is deflected, in plane parallel to the tension and compression sides, the tip should exhibit simple oscillation in that plane. Small adjustments can be made by rotating the shaft until such oscillation is achieved. This provision will facilitate frequency testing immediately after the seam location is carried out. A frequency testing device may be located to the right as viewed in FIG. 6.

It will be apparent that the face of club head may be oriented in a direction other than in the direction normal to the effective seam. It is preferred however that a normal to the club face be positioned parallel to a normal to the seam so as to avoid undesirable ball striking performance.

Having described the invention, variations will be apparent to those skilled in this art and it will be understood that such variations are within the scope of the appended claims.

What is claimed is:

1. Apparatus for locating the strongest point on a tubular golf club shaft, comprising:

a. a longitudinally elongated base;

b. a pair of supports for said tubular golf club shaft upstanding from said base and longitudinally spaced one from another; and c. means connected to said tubular golf club shaft for selectably exerting downward force on the tubular golf club shaft residing rotatably on said supports at a position substantially mid-way between said supports while permitting rotary motion of said tubular golf club shaft on said supports.

2. A method for locating the strongest point on a golf club shaft, comprising:

a. supporting the shaft at two longitudinally separated locations and rotating the shaft as supported thereby; and b. contacting the shaft in a direction transverse to that of the axis of the shaft with a downward force and a retractable gauge intermediate the locations during shaft rotation and detecting radial deviation of the shaft.

3. A method for locating the strongest point on a golf club shaft, comprising:

a. supporting the shaft at two longitudinally separated locations;

b. manually rotating the shaft at one of the two longitudinally separated locations;

c. contacting the shaft transversely to the axis of the shaft at a pre-determined position substantially intermediate the separated locations with a consistent downward force; and d. detecting radial deviation of the contacted portion of the shaft during shaft rotation.

* * * * *